US009635920B2

(12) United States Patent
Bourgeois

(10) Patent No.: US 9,635,920 B2
(45) Date of Patent: May 2, 2017

(54) ADJUSTABLE BELT FOR CARRYING BAGS OR THE LIKE

(75) Inventor: Vincent Bourgeois, Bassano del Grappa (IT)

(73) Assignee: BROOKS ENGLAND LIMITED, Smethwick, Birmingham (GB)

( * ) Notice: Subject to any disclaimer, the term of this patent is extended or adjusted under 35 U.S.C. 154(b) by 1090 days.

(21) Appl. No.: 12/671,623

(22) PCT Filed: Aug. 8, 2008

(86) PCT No.: PCT/IB2008/053188

§ 371 (c)(1),
(2), (4) Date: Feb. 1, 2010

(87) PCT Pub. No.: WO2009/019666

PCT Pub. Date: Feb. 12, 2009

(65) Prior Publication Data

US 2011/0226827 A1 Sep. 22, 2011

(30) Foreign Application Priority Data

Aug. 9, 2007 (IT) ..... VI2007A0232

(51) Int. Cl.

| | |
|---|---|
| ***A45F 3/14*** | (2006.01) |
| ***A45F 3/00*** | (2006.01) |
| ***A45F 3/04*** | (2006.01) |
| ***A45C 7/00*** | (2006.01) |
| ***A45C 13/26*** | (2006.01) |
| ***A45C 13/30*** | (2006.01) |

(52) U.S. Cl.
CPC ..... *A45C 13/30* (2013.01)

(58) Field of Classification Search
CPC ..... A45F 3/047; A45F 2003/007; A45F 2003/025; A45F 2003/045
USPC ..... 224/258, 604, 625–656, 578, 607, 610; 150/108
See application file for complete search history.

(56) References Cited

U.S. PATENT DOCUMENTS

| | | | | |
|---|---|---|---|---|
| 1,302,312 | A * | 4/1919 | Cook | 224/618 |
| 2,691,399 | A * | 10/1954 | Tompkins | 206/315.11 |
| 4,279,367 | A * | 7/1981 | Jacobs | 224/257 |
| 4,810,102 | A * | 3/1989 | Norton | A45C 1/04 150/108 |
| 4,819,845 | A * | 4/1989 | Byrd | 224/603 |
| 4,878,606 | A | 11/1989 | Miller | |
| 4,887,751 | A | 12/1989 | Lehman | |
| 4,923,105 | A * | 5/1990 | Snyder | 224/255 |
| 5,129,560 | A * | 7/1992 | Herman | 224/579 |
| 5,370,286 | A * | 12/1994 | Newman | 224/578 |
| 5,437,401 | A * | 8/1995 | Seltzer | 224/578 |

(Continued)

FOREIGN PATENT DOCUMENTS

DE 102005025245 A1 12/2006

*Primary Examiner* — Derek Battisti
(74) *Attorney, Agent, or Firm* — Tutunjian & Bitetto, P.C.

(57) ABSTRACT

Adjustable strap bags and the like for use during cycling or motorcycling, which includes an elongate flexible member designed to be secured to a bag or the like, wherein said elongate flexible member includes a first portion of adjustable length ($I_1$) which is designed to lie upon the shoulders of a user and a second portion of adjustable length ($I_2$) which is designed to encircle the waist of the user thereby stabilizing the bag and holding it tight thereagainst.

6 Claims, 5 Drawing Sheets

(56) References Cited

U.S. PATENT DOCUMENTS

| | | | | |
|---|---|---|---|---|
| 5,893,503 | A * | 4/1999 | Jean | 224/626 |
| 5,950,894 | A * | 9/1999 | Haber | 224/627 |
| D420,514 | S * | 2/2000 | Morlet | D3/327 |
| 6,164,505 | A * | 12/2000 | Holter et al. | 224/259 |
| 6,622,899 | B1 * | 9/2003 | Klindworth-Garron | 224/578 |
| 7,070,077 | B2 * | 7/2006 | Egart et al. | 224/625 |
| 7,909,214 | B2 * | 3/2011 | Gold et al. | 224/625 |
| 7,959,046 | B2 * | 6/2011 | Burnsed et al. | 224/150 |
| 8,371,061 | B2 * | 2/2013 | Bergers | 43/55 |
| 2005/0224533 | A1 * | 10/2005 | McCraney | 224/150 |
| 2006/0289585 | A1 * | 12/2006 | Godshaw et al. | 224/625 |
| 2007/0057002 | A1 * | 3/2007 | Timm et al. | 224/625 |
| 2008/0006668 | A1 * | 1/2008 | Nowacki et al. | 224/625 |
| 2014/0305437 | A1 * | 10/2014 | Zhu et al. | 128/205.22 |

* cited by examiner

ADJUSTABLE BELT FOR CARRYING BAGS OR THE LIKE

BACKGROUND

Technical Field

The present invention generally finds application in the art of sports and leisurewear, and particularly relates to an adjustable strap for bags, pouches, backpacks and similar accessories for use during cycling or motorcycling.

Description of Related Art

Clothing accessories such as bags, pouches, backpacks and similar containers to be carried upon the shoulders of a user, are known to possibly have one or more straps fixedly or removably secured to the accessory at two or more attachment points, allowing them to be worn over the shoulders for more comfortable transport.

Typically, the straps are formed of a single band of natural or synthetic fabric, with one or more portions folded upon themselves to allow adjustment of the working length of the strap to fit the user's height.

Adjustment is generally carried out by moving a slider along the belt to change the length of the folded portions and hence the working length of the strap.

Nonetheless, in the case of bags or other similar containers that are designed to be carried both by a walking user or during cycling or motorcycling, the working length of the strap has to be adjusted in response to the conditions of use.

In fact, a user that rides a bicycle or a motorcycle will usually wear the bag behind his/her back with the strap worn diagonally over the shoulders.

Conversely, a walking user will carry the bag in a substantially vertical position, and the working length of the strap will be smaller than in the case of a bicycle.

A well-known drawback of prior art solution is that any working length adjustment to fit a walking use will involve the loss of the adjustment to fit the bicycle riding use.

Therefore the strap length needs to be adjusted from time to time to fit a particular use of the bag, which involves an inconvenient and time-consuming operation for the user.

Bags are also known which are specially designed to be carried by a riding user. These bags have a cross strap designed to be obliquely worn by a user for the bag to fit tightly at the back of the user.

Furthermore, an additional pair of side straps may be provided for stable attachment of the bag to the user's body, which have mutual fastening means allowing them to be locked and worn at the waist. These bags are very uncomfortable to be worn and carried by a walking user.

Furthermore, three or even more members are required to be joined to the bag by sewing, gluing or the like in a given number of constraint areas which will involve corresponding weakening areas for the bag structure.

Last but not least, such assemblies are relatively expensive and involve a relatively time-consuming fabrication, as a result of the number of parts to be provided therefor.

SUMMARY OF THE INVENTION

The main object of the present invention is to provide an adjustable strap for carrying bags or similar containers, that obviates the above prior art drawbacks.

A particular object is to provide a strap for carrying bags or the like, which affords stable positioning of a bag or similar container when the bag is worn by a user riding on a bicycle, a motorcycle or other similar vehicle.

Another particular object is to provide an adjustable strap for bags or the like that can always fit the particular anatomy of a user regardless of the bag carrying mode and does not require the user to readjust it each time that he/she changes such carrying mode, while using a relatively small number of parts.

A further object is to provide a strap for carrying bags or the like, that ensures a tight fit of the bag at the user's back using a relatively small number of parts.

Yet another object of the invention is to provide a strap that can be secured to a bag designed for use by a bicycle or motorcycle riding user, and can be attached to the bag or the like at two locations only.

Yet another object is to provide an adjustable strap that is designed for use both by a walking user and by a bicycle or a motorcycle user, without affecting comfort and stable fit of the bag against the user's body.

These and other objects, as better explained hereafter, are fulfilled by an adjustable strap for carrying bags or the like as defined in claim 1, which comprises an elongate flexible member securable to a bag or the like and including a first portion of adjustable length which is designed to lie upon the shoulders of a user and a second portion of adjustable length which is designed to encircle the waist of the user thereby stabilizing the bag and holding it tight thereagainst.

By this particular arrangement, the strap of the invention allows comfortable carrying and stable positioning of the bag or similar container to which the strap is from time to time secured, as well as tight fit thereof at the user's back.

Advantageously, the strap may have first adjustment means for adjusting the length of said first adjustable portion and second adjustment means for adjusting said second adjustable portion, said first adjustment means being independent of said second means, thereby allowing adjustment of the length of said first adjustable portion, while leaving the length of said second adjustable portion unchanged.

Thus, the strap may be adjusted to readily fit various modes of use, and will not require repeated adjustment to fit various bag caring modes.

BRIEF DESCRIPTION OF THE DRAWINGS

Further features and advantages of the invention will be more apparent upon reading the detailed description of a preferred, non-exclusive embodiment of an adjustable strap for carrying bags or the like according to the invention, which is described as a non-limiting example with the help of the annexed drawings, in which.

DETAILED DESCRIPTION OF PREFERRED EMBODIMENTS

Referring to the above figures, the strap of the invention, generally designated by numeral 1, may be fixedly or removably mounted to a bag, a pouch, a backpack or a similar container and is particularly suitable to be carried by a user riding a bicycle, a motorcycle or a similar vehicle.

Figure 1:
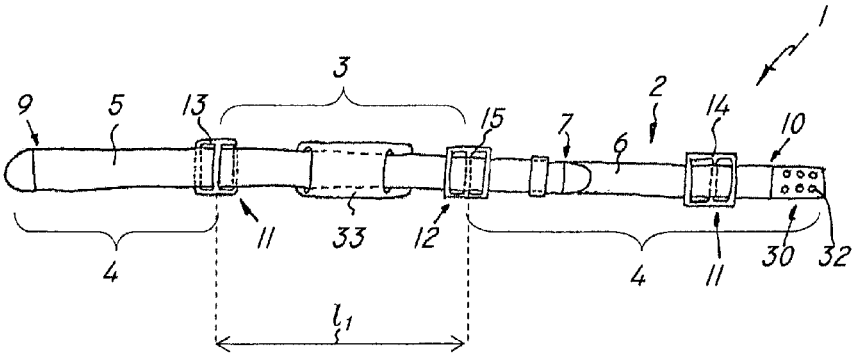
FIG. 1 is a front view of a strap of the invention.
Figure 2:
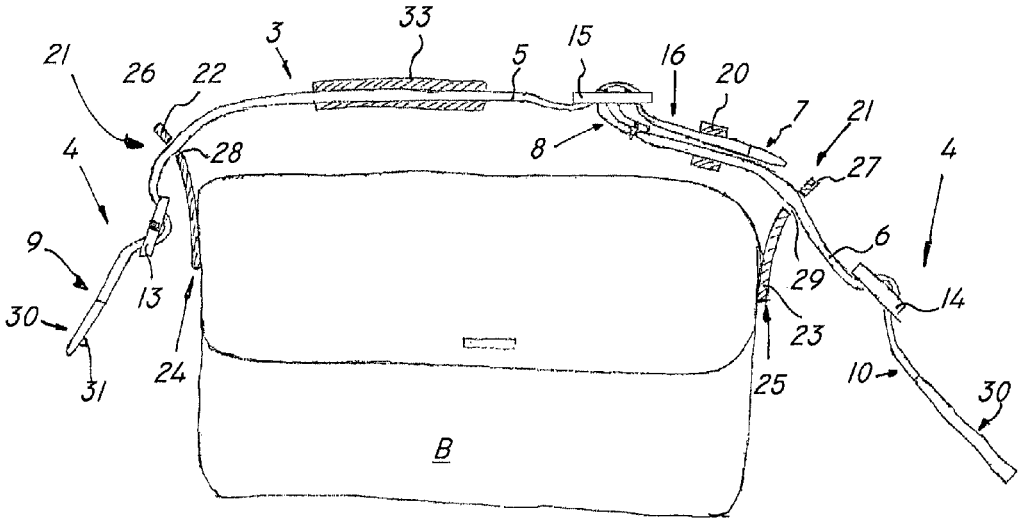
FIG. 2 is a perspective view of a strap of the invention attached to a bag in a particular configuration.
Figure 3:
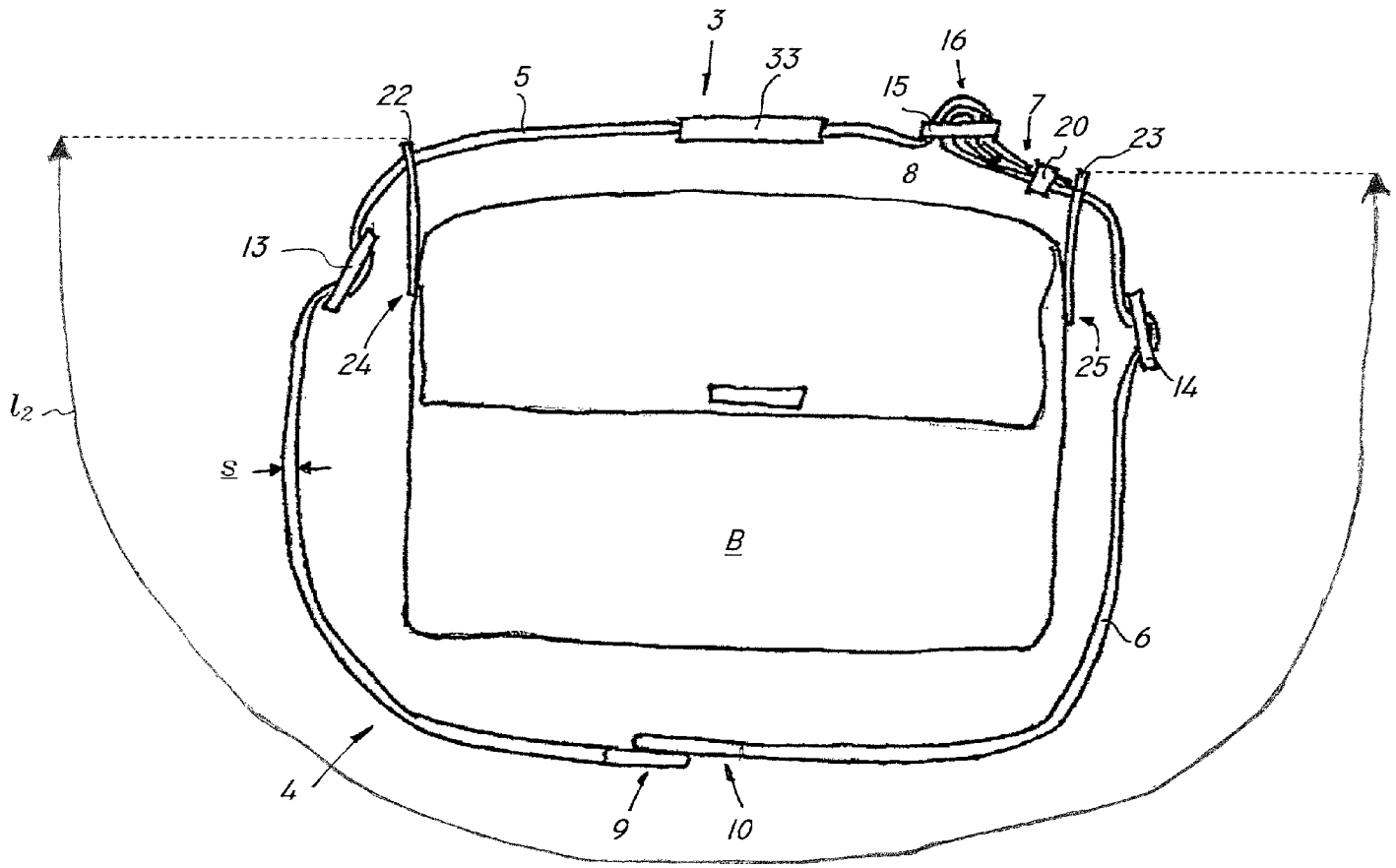
FIG. 3 is a perspective view of a strap of the invention attached to a bag in another configuration.

As shown in FIGS. 1 to 3, a strap of the invention comprises an elongate flexible member 2 designed to be secured to a bag B or the like, and having a first portion 3 of adjustable length $l_1$ which is designed to lie upon the shoulders of a user U and a second portion 4 of adjustable length $l_2$ which is designed to encircle the waist of the user U and thereby stabilize the bag B and hold it tight thereagainst.

Figure 5:
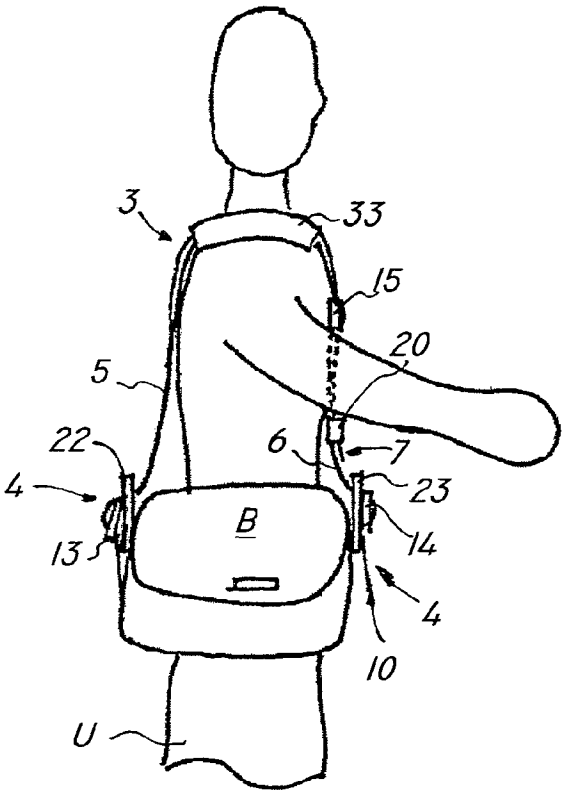
FIG. 5 is a lateral view of FIG. 4.
Figure 4:
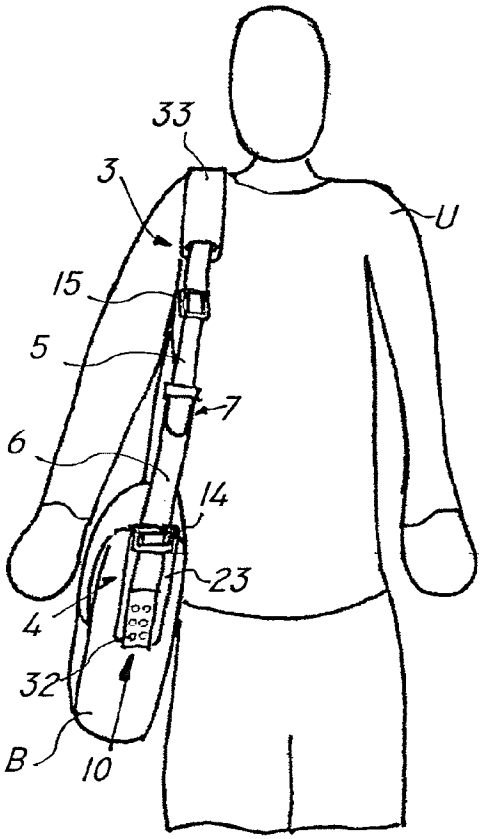
FIG. 4 is a front view of a strap of the invention attached to a bag and worn by a user in a first mode of use.

Therefore, in a first mode of use, as shown in FIGS. 4 and 5, a bag B or a similar container designed to receive the strap 1 of the invention mounted thereon, may be carried in a substantially vertical position at a side of a user U with the strap 1 lying upon one of his/her shoulders.

In this case, the second adjustable portion 4 of the elongate member 2 may not encircle the waist of the user U and may be kept free.

Figure 7:
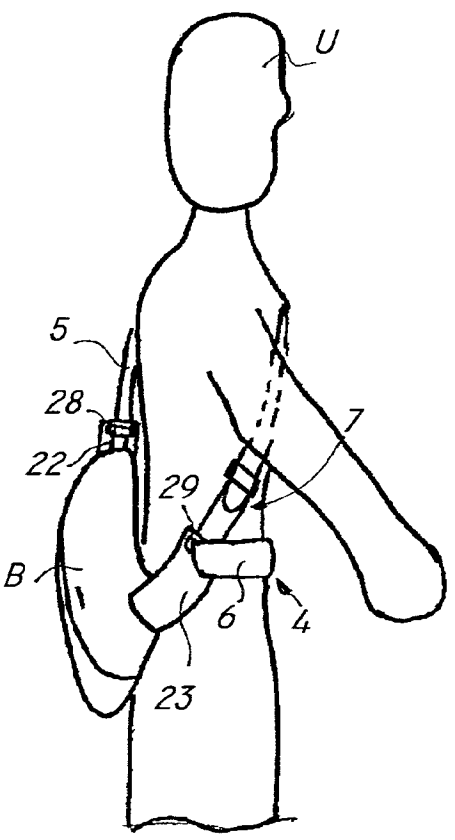
FIG. 7 is a lateral view of FIG. 6.
Figure 6:
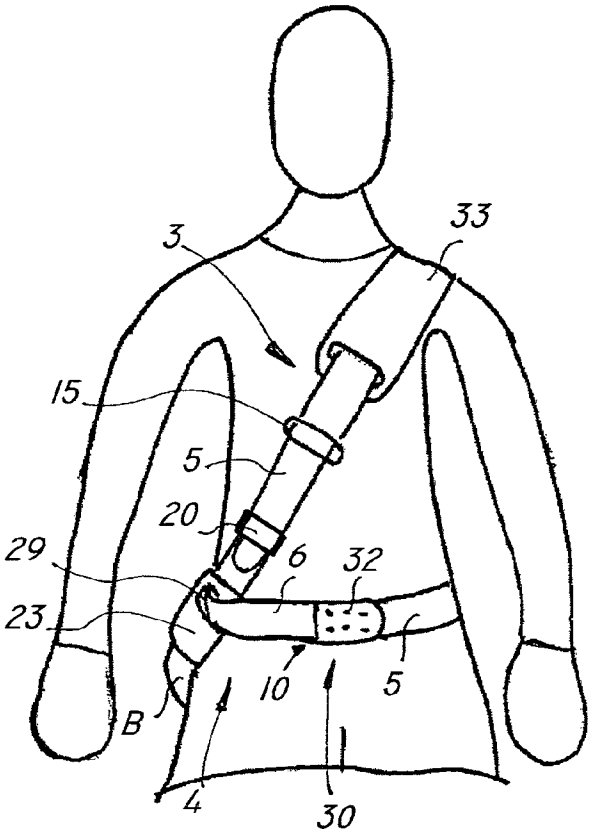
FIG. 6 is a front view of a strap of the invention attached to a bag and worn by a user in a second mode of use.

In another mode of use, as shown in FIGS. 6 and 7, which is particularly suitable for a user U riding a bicycle or a similar vehicle, the strap 1 may be worn with the first adjustable portion 3 obliquely lying upon the shoulder and around the torso of the user U.

On the other hand, the second adjustable portion 4 may encircle the waist of the user U and be locked at the front. Thus, the bag B will stably fit at the back of the user U and be comfortably held in position thereupon.

Advantageously, the elongate flexible member 2 may include first and second bands 5, 6 having respective first ends 7, 8 facing and slideably secured to each other at the first adjustable portion 3 and second free ends 9, 10 at the second adjustable portion 4.

Also, first and second adjustment means $l_1$, $l_2$ may be provided for adjusting the lengths $l_1$, $l_2$ of the first adjustable portion 3 and the second adjustable portion 4 respectively. The first adjustment means $l_1$ may be adjusted independent of the second adjustment means 12.

Thus, the length $l_1$ of the first adjustable portion 3 may be changed while leaving the length $l_2$ of the second adjustable portion 4 unchanged.

Thanks to this particular configuration of the invention, a user U that both walks and rides bicycles or similar vehicles will not be required to adjust the strap 1 each time he/she turns from walking to riding or vice versa, or changes the bag B carrying mode, e.g. turning from one to the other of the configurations as described above and shown in the annexed figures.

Particularly, the first adjustment means 11 may include first and second sliders 13, 14, which are adapted to longitudinally slide along second ends 9, 10 of the first and second bands 5, 6 respectively.

The second adjustment means 12 may include a third slider 15 which is adapted to longitudinally slide along the first end 7 of the first band 5 to change the portion 16 of the first band 5 facing the second 6, thereby adjusting the length of the first adjustable portion 3 of the elongate member 2 to fit the anatomy of the user U and particularly his/her waist size.

The sliders 13, 14, 15 may be substantially similar, and be comprised of a substantially plate-like body of metal, plastic or another material with adequate mechanical properties, having a pair of substantially transverse slots 17, 18 and of a substantially central transverse stem 19.

Particularly, the slots 17, 18 are designed to receive the ends 7, 8, 9, 10 of the first and second bands 5,6 respectively.

For example, in a preferred, non exclusive configuration of the present invention as shown in the accompanying figures, the second ends 9, 10 of the first and second bands 5, 6 will engage the first and second sliders 13, 14 respectively, whereas the third slider 15 may be engaged by the first ends 7, 8.

Figure 8:
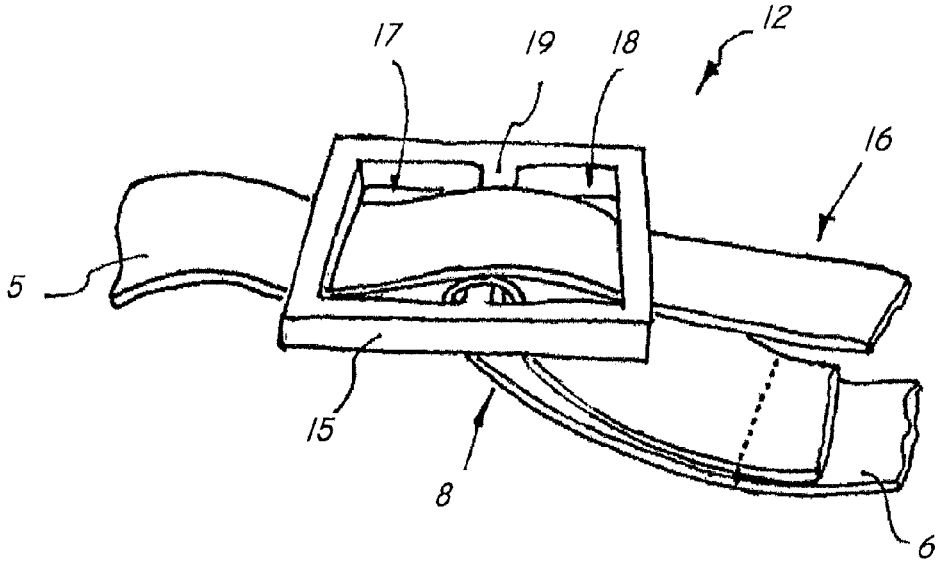
FIG. 8 is a front view of a first detail of a strap of the invention.

As more clearly shown in FIG. 8, the first end 8 of the second band 6 may be stably attached to the third slider 15, for example it may be bent into a U shape around the central stem 19 and fixed by sewing or other chemical or mechanical bond.

The first ends 7, 8 of the first and second bands 5, 6 may be held in mutually facing relation by a loop 20, a tie or the like, slideably mounted thereon.

Also, the strap 1 may have coupling means 21 for securing it to a bag B or the like, that can be associated with the first and second bands 5, 6 to delimit the first adjustable portion 3 of the elongate member 2.

For example, the coupling means 21 may include a pair of flaps 22, 23 each having one end, 24 and 25 respectively, adapted to be attached to a bag B or the like by known arrangements, and the opposite end, 26 and 27 respectively, having a passage 28, 29 for corresponding second ends 9, 10 of the first and second bands 5, 6.

Thus, the first adjustable portion 3 may be defined by the sections of the first and second bands 5, 6 delimited by the passages 28, 29 of the flaps 22, 23, whereas the second adjustable portion 4 may be defined by the sections of the first and second bands 5, 6 outside such passages 28, 29.

The latter may be advantageously designed to lock the sliders 13, 14, 15 and prevent them from moving from one side of the flaps 22, 23 to the other.

Thus, when the strap 1 is worn with the bag B at the side of the body of the user U, the first adjustable portion 3 of the elongate member 2 may substantially coincide with the sections of the first 5 and second bands 6 delimited by the first and second sliders 13, 14.

The length $l_1$ of the first portion 3 will be in any case equal to the length of the portion of the elongate member 2 delimited by the two passages 28, 29.

Conversely, the length $l_2$ of the second adjustable portion 4 will correspond to the overall length of the portions of the elongate member 2 outside the passages 28, 29, possibly without the part of the first end 8 of the second band 6 that faces the first end 7 of the first band 5, or vice versa.

In the configuration as shown in the Figures, the length $l_1$ of the first adjustable portion 3 will be simply adjusted by sliding the third slider 15 along the first band to change the portion 16 of the first band 5 overlying the second band 6.

For the second adjustable portion 4 to stably encircle the waist of a user U, mutual attachment means 30 may be provided for joining together the second ends 9, 10 of the first and second bands 5, 6 and allow a user U to attach them at the waist, preferably but without limitation at the front.

Figure 9:
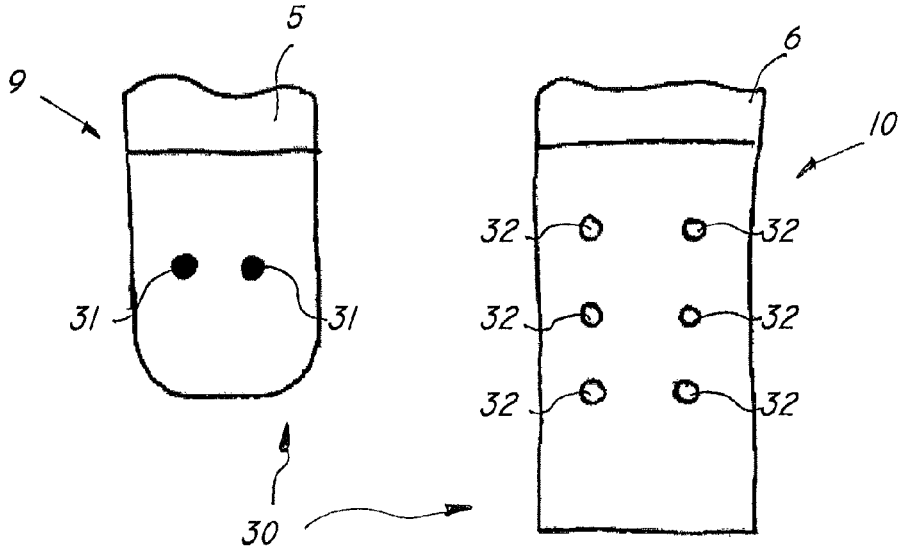
FIG. 9 is an enlarged view of further details of a strap of the invention.

As particularly shown in FIG. 9, the attachment means 30 may include at least one male member 31 on one of the second ends 9, 10 and at least one female receptacle 32 on the other second end 9, 10 for snap engagement with a male member 31.

In the illustrated configuration, which is described by way of example and without limitation to the invention, a pair of transversely spaced male members 31 are provided on the second end 9 of the first band 5, and three pairs of longitudinally spaced female receptacles 32 are formed on the second end 10 of the second band 6.

This will afford further customization of the attachment of the second portion 4 to fit the anatomy and preferences of the user U.

Nonetheless, it shall be understood that the configuration of the attachment means may be other than that described and shown herein.

Both the male members 31 and the female receptacles 32 may be provided in greater or smaller numbers as compared with the illustrated arrangement and may be formed on either or both bands 5, 6, in any spatial arrangement.

Also, the attachment means 30 as shown herein may be replaced by any other type of attachment means, as typically used in the manufacture of straps, belts or similar accessories to be mounted to bags or other clothing items.

The strap 1 may be also equipped with a shoulder pad 33, e.g. slideably mounted to the first band 5 at the first adjustable portion 3 and designed to contact the shoulder of the user U for improved comfort of the strap 1.

The materials used for the strap 1 may be selected from the group comprising leather, natural or synthetic fabric or nonwoven fabrics, and may be possibly supplemented with reinforcements of relatively stiff materials, such as metal or rigid plastic.

The two bands 5, 6 may be also formed of different materials, and each may also comprise several materials at the same time.

The above disclosure clearly shows that the invention fulfils the intended objects and particularly meets the requirement of providing an adjustable strap for carrying bags and the like that can be also used by a user riding a bicycle or a motorcycle, while still ensuring stability and tight fit of the bag against the user's body.

Thanks to the particular configuration of the first and second adjustment means 11, 12, the belt may be adjusted to fit various modes of use.

The strap of the invention is susceptible of a number of changes and variants, within the inventive concept disclosed in the appended claims. All the details thereof may be replaced by other technically equivalent parts, and the materials may vary depending on different needs, without departure from the scope of the invention.

While the strap has been described with particular reference to the accompanying figures, the numerals referred to in the disclosure and claims are only used for the sake of a better intelligibility of the invention and shall not be intended to limit the claimed scope in any manner.

The invention claimed is:

1. An adjustable strap for carrying a bag comprising:

a bag comprising an opposing pair of flaps, each flap affixed to opposite ends of the bag and each flap including a passage formed therein, an elongate flexible member slidably secured to the flaps of the bag, the elongate flexible member comprising:

a first band having a first end slidably attached to a third slider and a second end comprising a first slider slidably attached thereon;

a second band having a first end stably secured to the third slider and overlapping the first end of the first band, and a second end comprising to a second slider slidably attached thereon, wherein each of the second ends of the first and second bands pass through each respective passage of the opposing flaps and are slidably secured to the flaps by each of the first and second sliders being placed outside each of the flaps, wherein the third slider remains in between the opposing pair of flaps, wherein the passage formed in each flap permits pass through of the bands but prevents pass through of the first, second or third sliders, wherein a first portion of adjustable length ($I_1$) of the elongate flexible member is designed to lie upon the shoulders of a user (U) and is oriented in between the two opposing flaps of the bag and includes the third slider, and wherein each terminal end of the second ends of the first band and the second end of the second band include mutual attachment means for enabling direct attachment of the second ends to each other to comprise a second portion of adjustable length ($I_2$) which is independently adjustable with respect to the first portion and designed to encircle the waist of the user (U).

2. The strap of claim 1, wherein said third slider is adapted to longitudinally slide along first ends of said first and second bands respectively.

3. The strap of claim 1, wherein said third slider is designed to adjust the length ($l_1$) of said first adjustable portion, while leaving the length ($l_2$) of said second adjustable portion unchanged.

4. The strap of claim 1, wherein the first and second sliders are adapted to longitudinally slide along the second ends of said first band and second band to adjust the length of said second adjustable portion of said elongate member.

5. The adjustable strap of claim 1, wherein said attachment means includes at least one male member on one of said second ends and at least one female receptacle on the other second end, for snap engagement with said at least one male member.

6. The adjustable strap of claim 5, wherein said attachment means includes a plurality of said female receptacles in longitudinally spaced relation to allow customized attachment of said at least one male member to fit the size of the body of the user (U).

* * * * *